US008184059B2

(12) United States Patent
Bunch et al.

(10) Patent No.: US 8,184,059 B2
(45) Date of Patent: May 22, 2012

(54) SYSTEMS AND METHODS FOR POWERING A GIMBAL MOUNTED DEVICE

(75) Inventors: Brian P. Bunch, Snohomish, WA (US); Steve Mowry, Duvall, WA (US); Paul Ferguson, Redmond, WA (US)

(73) Assignee: Honeywell International Inc., Morristown, NJ (US)

( * ) Notice: Subject to any disclaimer, the term of this patent is extended or adjusted under 35 U.S.C. 154(b) by 799 days.

(21) Appl. No.: 12/258,170

(22) Filed: Oct. 24, 2008

(65) Prior Publication Data

US 2010/0101341 A1 Apr. 29, 2010

(51) Int. Cl.
*H01Q 3/00* (2006.01)

(52) U.S. Cl. ..... 343/766; 343/754; 343/757; 343/763; 343/878; 343/882; 343/765

(58) Field of Classification Search ..... 343/754, 343/757, 759, 763, 766, 869, 878, 882, 765; 74/5

See application file for complete search history.

(56) References Cited

U.S. PATENT DOCUMENTS

| | | | | |
|---|---|---|---|---|
| 4,404,592 | A | 9/1983 | Pepin et al. | |
| 4,425,905 | A | 1/1984 | Mori | |
| 4,433,337 | A * | 2/1984 | Smith et al. | 343/765 |
| 4,529,986 | A | 7/1985 | d'Auria et al. | |
| 5,838,278 | A | 11/1998 | Tsujisawa et al. | |
| 6,262,687 | B1 | 7/2001 | Bai et al. | |
| 6,417,814 | B1 * | 7/2002 | Hupka et al. | 343/757 |
| 6,911,950 | B2 * | 6/2005 | Harron | 343/766 |
| 7,183,966 | B1 | 2/2007 | Schramek et al. | |
| 7,262,679 | B2 * | 8/2007 | Mehdizadeh et al. | 336/84 R |
| 7,378,769 | B2 * | 5/2008 | Head | 310/87 |
| 7,933,477 | B2 | 4/2011 | Shigeno et al. | |
| 2002/0083573 | A1 | 7/2002 | Matz et al. | |
| 2002/0084948 | A1 | 7/2002 | Watson | |
| 2002/0184640 | A1 | 12/2002 | Schnee et al. | |
| 2003/0030863 | A1 | 2/2003 | Frey et al. | |
| 2003/0194177 | A1 | 10/2003 | Tietjen | |

(Continued)

FOREIGN PATENT DOCUMENTS

GB 1051913 12/1996

(Continued)

OTHER PUBLICATIONS

Ishwar D. Aggarwal et al.; Infrared (IR) Photonic Bandgap Fibers for Missile Defense; Article in Aircraft Survivability, Summer 2006; pp. 12-15; Published by the Joint Aircraft Survivability Program Office; http://www.bahdayton.com/surviac/asnews/as%20Journal%20 Summer%202006.pdf.

*Primary Examiner* — Jacob Y Choi
*Assistant Examiner* — Shawn Buchanan
(74) *Attorney, Agent, or Firm* — Lowe Graham Jones PLLC

(57) ABSTRACT

Gimbal power systems and methods are operable to provide power to a device attached to the gimbal. An exemplary embodiment is configured to rotate a rotational member of the gimbal system about an axis, wherein a stator of a rotary power transformer affixed to the rotational member rotates about the axis, and wherein an end of an electrical connection coupled to a power connector of a rotor winding of the rotary power transformer remains substantially stationary as the stator of the rotary power transformer rotates about the axis.

6 Claims, 4 Drawing Sheets

U.S. PATENT DOCUMENTS

| | | | | |
|---|---|---|---|---|
| 2004/0061601 | A1* | 4/2004 | Freakes et al. | 340/442 |
| 2005/0164636 | A1 | 7/2005 | Palermo et al. | |
| 2007/0008514 | A1 | 1/2007 | Krasutsky | |
| 2007/0075182 | A1 | 4/2007 | Fetterly | |
| 2007/0075237 | A1 | 4/2007 | Mills et al. | |
| 2007/0194170 | A1 | 8/2007 | Ellison et al. | |
| 2007/0217736 | A1 | 9/2007 | Zhang et al. | |
| 2008/0084357 | A1 | 4/2008 | Smeltzer | |
| 2010/0092179 | A1* | 4/2010 | Bunch et al. | 398/116 |

FOREIGN PATENT DOCUMENTS

| | | | |
|---|---|---|---|
| GB | 2310975 | A | 10/1997 |
| JP | 2007274057 | A | 10/2007 |
| WO | 0205383 | A1 | 1/2002 |
| WO | 2006065892 | A2 | 6/2006 |
| WO | 2008141297 | A1 | 11/2008 |

* cited by examiner

SYSTEMS AND METHODS FOR POWERING A GIMBAL MOUNTED DEVICE

BACKGROUND OF THE INVENTION

Various devices may be mounted on a single axis, a two-axis, or a three-axis gimbal to facilitate orientation of the device towards a desired direction. FIG. 1 illustrates an exemplary power system for a prior art radar antenna 102 and a two-axis gimbal system 104. When a device, such as the radar antenna 102, is affixed to the gimbal system 104, the device may be pointed in a desired horizontal and/or vertical direction. When the gimbal system 104 includes motors, the device may be oriented on a real time basis.

For example, when the radar antenna 102 is used in a vehicle, such as an aircraft or a ship, the radar antenna 102 may be continuously swept in a back-and-forth manner along the horizon, thereby generating a view of potential hazards on a radar display. As another example, the radar antenna 102 may be moved so as to detect a strongest return signal, wherein a plurality of rotary encoders or other sensors on the gimbal system 104 provide positional information for determining the direction that the radar antenna 102 is pointed. Thus, based upon a determined orientation of the radar antenna 102, and also based upon a determined range of a source of a detected return signal of interest, a directional radar system is able to identify a location of the source.

The two-axis gimbal system 104 includes a support member 106 with one or more support arms 108 extending therefrom. A first rotational member 110 is rotationally coupled to the support arms 108 to provide for rotation of the radar antenna 102 about the illustrated Z-axis. The first rotational member 110 is rotationally coupled to a second rotational member 112 to provide for rotation of the radar antenna 102 about the illustrated Y-axis, which is perpendicular to the Z-axis.

A moveable portion 114 of the gimbal system 104 may be oriented in a desired position. One or more connection members 116, coupled to the moveable portion 114, secure the radar antenna 102 to the gimbal system 104. Motors (not shown) operate the rotational members 110, 112, thereby pointing the radar antenna 102 in a desired direction.

The gimbal system 104 is affixed to a base 118. The base 118 may optionally house various electronic components therein (not shown), such as components of a radar system.

Motors (not shown) on the two-axis gimbal system 104 require power for operation. Further, the device mounted on the two-axis gimbal system 104 may require power. For example, the radar antenna 102 requires power to generate the initial radar signal, and circuitry of the communication device 120 requires power for operation.

To provide power to the gimbal motors, an electrical connection 122 is coupled to a power source (not shown) and the gimbal motors. The electrical connection 122 is illustrated as coupling to the base 118 at an attachment point 124. To provide power to the communication device 120, an electrical connection 126 is coupled to the power source (not shown) and the communication device 120. The electrical connection 126 is also illustrated as coupling to the base 118 at an attachment point 128. It is appreciated that the gimbal motors and the communication device 120 may be operated off of the same power supply providing a commonly used voltage and/or frequency, may be operated off different power supplies, or may have intervening devices which condition the power as necessary, such as a voltage changing transformer, an alternating current (AC) to direct current (DC) converter, a voltage divider circuit, etc.

As illustrated in FIG. 1, the electrical connection 122 and the electrical connection 126 are physically coupled to the base 118 in the exemplary system. The electrical connections 122, 126 flex as the communication device 120 and the antenna 102 are moved by the gimbal system 104.

Over long periods of time, the electrical connections 122, 126, and/or their respective points of attachment 124, 128, may wear and potentially fail due to the repeated flexing as the radar antenna 102 is moved by the gimbal system 104. Failure of the electrical connections 122, 126 may result in a hazardous operating condition, such as when the radar antenna 102 and the gimbal system 104 are deployed in an aircraft. Thus, failure of one or both of the electrical connections 122, 126 would cause a failure of the aircraft's radar system. Accordingly, it is desirable to prevent failure of the electrical connections 122, 126 so as to ensure secure and reliable operation of the radar antenna 102.

SUMMARY OF THE INVENTION

Systems and methods of powering a gimbal mounted device are disclosed. An exemplary embodiment is configured to rotate a first rotational member of the gimbal system about a first axis, wherein a stator of a first rotary power transformer affixed to the first rotational member rotates about the first axis, and wherein an end of a first electrical connection coupled to a power connector of a rotor winding of the first rotary power transformer remains substantially stationary as the stator of the first rotary power transformer rotates about the first axis. Further, the exemplary embodiment is configured to rotate a second rotational member of the gimbal system about a second axis, wherein a stator of a second rotary power transformer affixed to the second rotational member rotates about the second axis, and wherein an end of a second electrical connection coupled to a power connector of a rotor winding of the second rotary power transformer remains substantially stationary as the stator of the second rotary power transformer rotates about the second axis.

BRIEF DESCRIPTION OF THE DRAWINGS

Preferred and alternative embodiments are described in detail below with reference to the following drawings.

DETAILED DESCRIPTION OF THE PREFERRED EMBODIMENT

Figure 1:
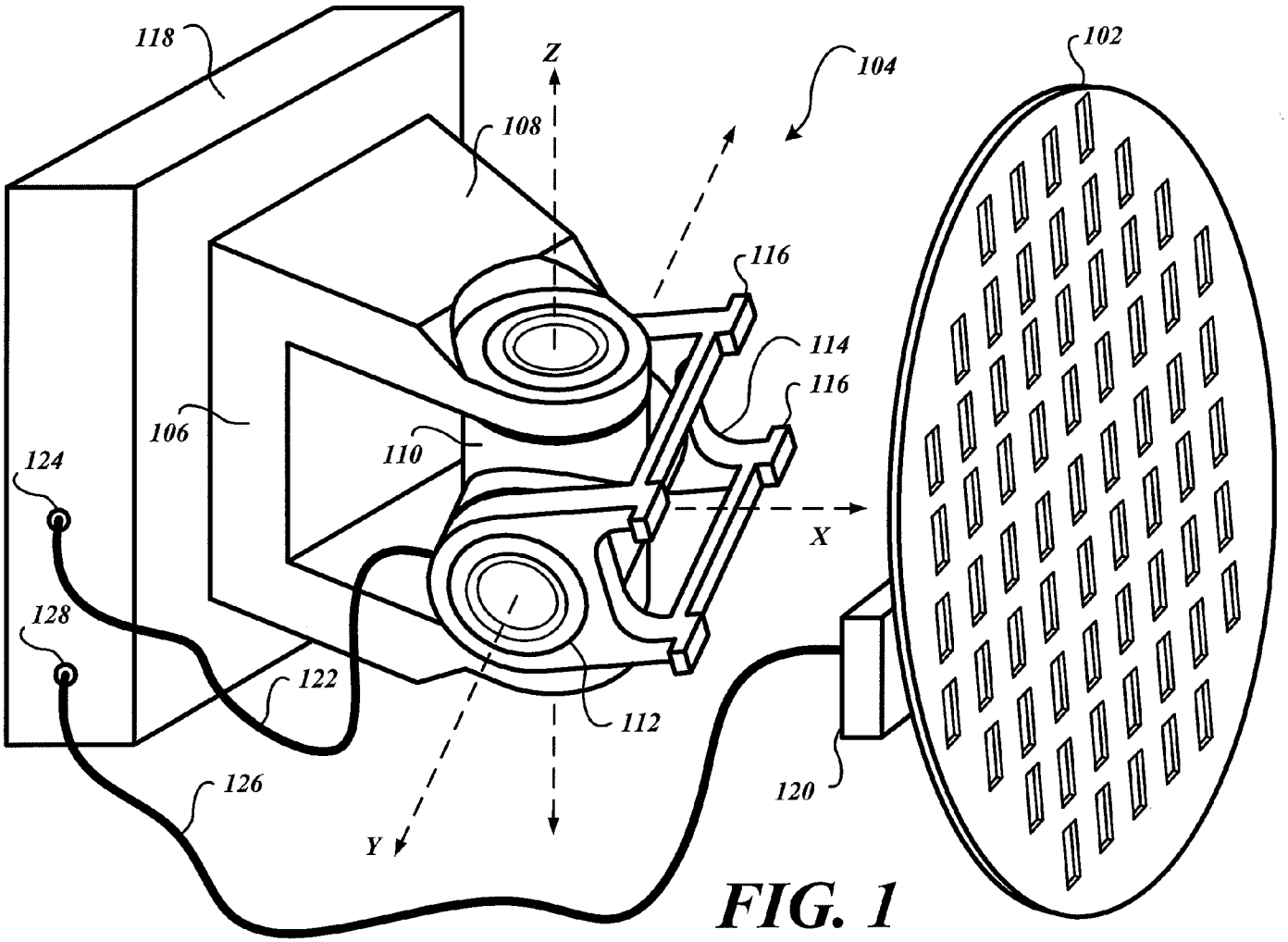
FIG. 1 (PRIOR ART)
FIG. 1 illustrates an exemplary power system for a prior art radar antenna and a two-axis gimbal system.
Figure 2:
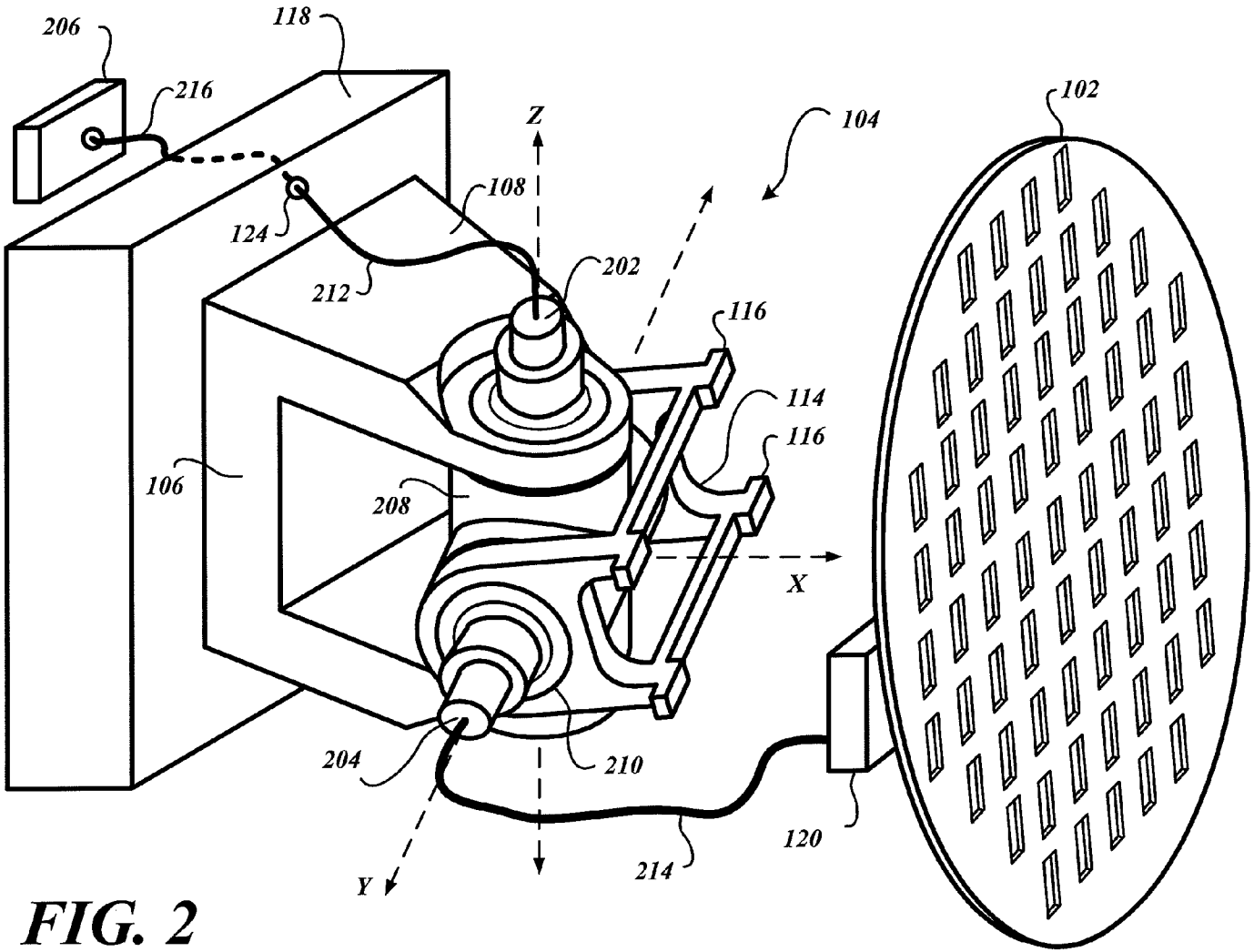
FIG. 2 is a perspective view of a power transfer gimbal system.

FIG. 2 is a perspective view of a power transfer gimbal system 200. The exemplary power transfer gimbal system 200 is illustrated as a two-axis gimbal. A first rotary power transformer 202 and a second rotary power transformer 204 are part of a power transfer path between the communication device 120, the antenna 102, and a remotely located power source 206.

The first rotary power transformer 202 is integrated into, or attached to, a first rotational member 208. The first rotational member 208 is rotationally coupled to the support arms 108 to provide for rotation of the radar antenna 102 about the illustrated Z-axis. The first rotational member 208 is similar to the above-described first rotational member 110. However, the first rotational member 208 is configured to receive and secure the first rotary power transformer 202.

The second rotary power transformer 204 is integrated into, or attached to, a second rotational member 210. The second rotational member 210 provides for rotation of the radar antenna 102 about the illustrated Y-axis, which is perpendicular to the Z-axis. The second rotational member 210 is similar to the above-described second rotational member 112. However, the second rotational member 210 is configured to receive and secure the second rotary power transformer 204.

Figure 3:
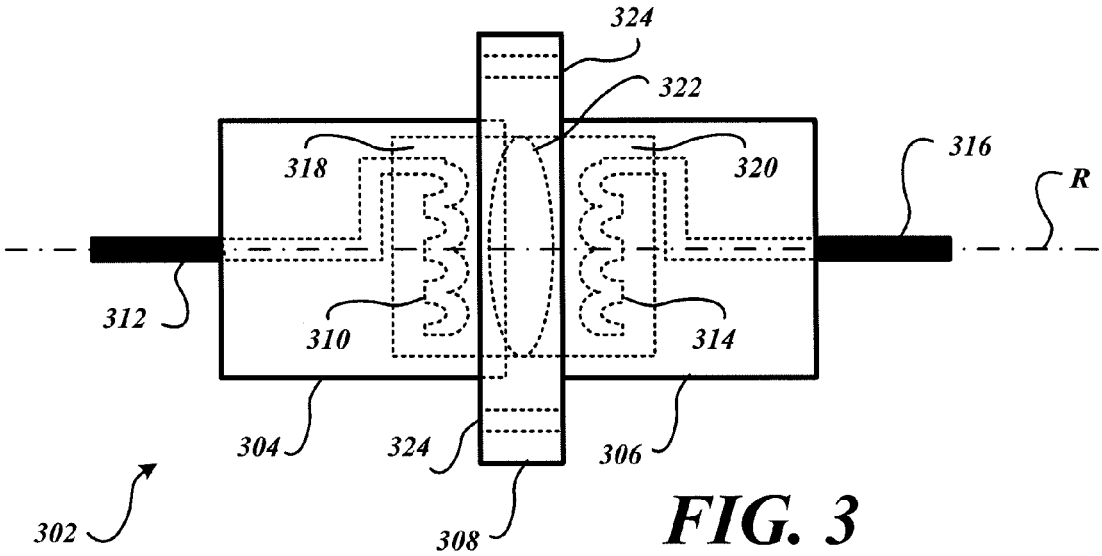
FIG. 3 is a simplified block diagram of a rotary power transformer employed by embodiments of the power transfer gimbal system.

FIG. 3 is a simplified block diagram of an exemplary rotary power transformer 302 employed by embodiments of the power transfer gimbal system 200. The exemplary rotary power transformer 302 corresponds to the first rotary power transformer 202 and the second rotary power transformer 204 illustrated in FIG. 2.

The rotary power transformer 302 comprises a rotor 304, a stator 306, and stator connector 308, such as a collar. Within the rotor 304 is a rotor winding 310 that is coupled to a power connector 312 that extends out from the rotor 304 to provide connectivity to an electrical connection (not shown). Within the stator 306 is a stator winding 314 that is coupled to a power connector 316 that extends out from the stator 306 to provide connectivity to an electrical connection (not shown). The windings 310, 314 are preferably made of insulated conductors.

In some embodiments, a cavity 318 is formed in the rotor 304 and a cavity 320 is formed in the stator 306. The cavities 318, 320 may be filled with air, or optionally, another suitable material or gas. In the exemplary embodiments, a magnetic field is established between the windings 310, 314 in an air gap 322. Electrical power is transferred between the windings 310, 314 as an alternating current (AC) is passed through a first winding to induce an AC current in the second winding. Further, an AC voltage applied at the first winding induces a corresponding AC voltage at the second winding. The transfer of power through transformer windings 310, 314 and across the air gap 322 is well known in the arts and is not described herein for brevity.

Adjacent coiled portions of the windings 310, 314 are designed so as to control the magnitudes of the current and voltage induced on the second winding when the AC current, at an operating AC voltage, is passed through one of the windings 310, 314, referred to herein as the source winding. Power is then induced in the other one of the windings 310, 314, referred to herein as the load winding. Depending upon the direction of power transfer, either one of the rotor winding 310 or the stator winding may be the source winding, while the other winding is the load winding.

The number of turns of the source winding relative to the number of turns of the load winding define a turns ratio. The turns ratio defines the relative voltages and currents induced on the load winding by the source winding. It is appreciated that the design and configuration of the windings 310, 314 may be tailored to the particular application at hand. Accordingly, voltages from the power source 206 need not match the voltage used by the device coupled to the gimbal, such as the exemplary communication device 120 and/or the antenna 102, or the voltage used by the gimbal motors.

The power connectors 312, 316 are aligned along a common axis of rotation (R). The rotor 304 is free to rotate about the axis of rotation. Since the power connector 312 is secured to the rotor 304, the rotational member is free to rotate without imparting a stress on the electrical connection that is coupled to the power connector 316. The relative position of the rotor winding 310 and the stator winding 314 are configured so as to keep the turn ratio and the dimensions of the air gap 322 substantially constant during rotation of the rotor 304.

The power connectors 312, 316 may be any suitable connector, such as, but not limited to, a spade type connector, a screw type connector, a snap type connector, a clip type connector, or the like. The power connectors 312, 316 are configured to provide for a secure and efficient electrical connection with an end of an electrical connection. The end of the electrical connection preferably has a corresponding power connector attached thereto which corresponds to the power connectors 312, 316. Thus, the corresponding power connector at the end of the electrical connection is configured to mate with the power connectors 312, 316.

The stator connector 308 attaches the stator 306 to the rotational member 208, 210 of the power transfer gimbal system 200. For convenience, the rotational member 208 is illustrated as a collar with a plurality of apertures 324 through which screws, bolts or other suitable fasteners may be used to secure the rotary power transformer 302 to its respective rotational member (not shown). Alternative embodiments may employ other types of fasteners to facilitate coupling of the stator 306 to the rotational member. For example, a slot or groove may be configured to mate with a protrusion or the like. Friction or a fastener may secure the protrusion in the slot or groove. The slot or groove may be fabricated in the stator 306, or may be fabricated in the rotational member of the power transfer gimbal system 200.

Figure 4A:
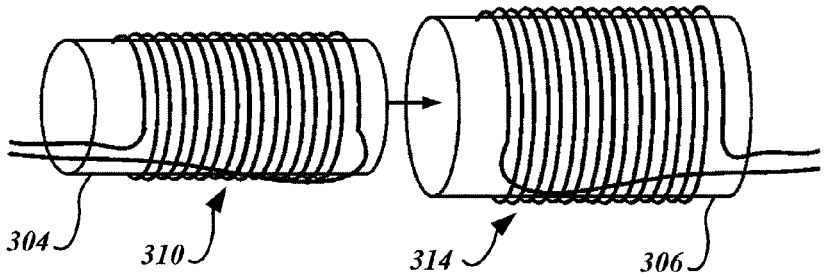
FIGS. 4A and 4B illustrate an exemplary rotor and stator winding configuration.
Figure 4B:
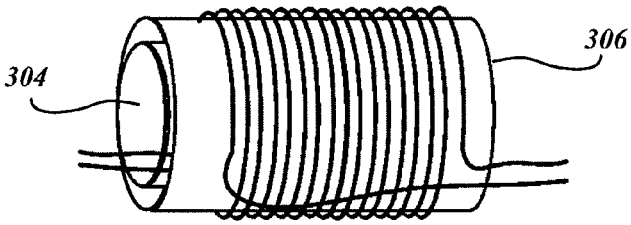

FIGS. 4A and 4B illustrate an exemplary rotor winding 310 and stator winding 314 configuration. The rotor winding 310 is wound about the rotor 304 a plurality of "n1" times. The stator winding 314 is wound about the stator 306 a plurality of "n2" times. The turns ratio is either n1/n2, or n2/n1, depending upon the direction of power transfer.

Figure 5:
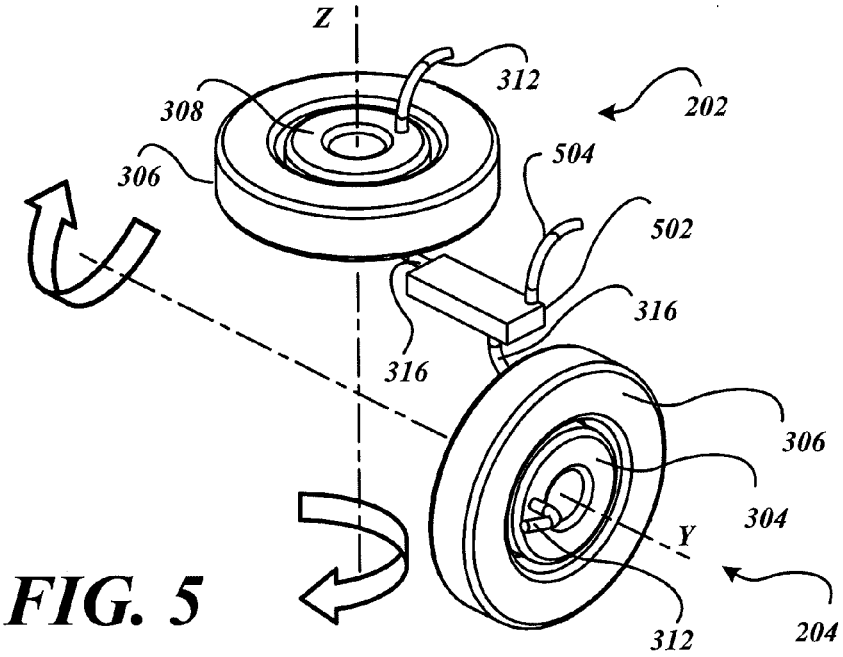
FIG. 5 illustrates a multi-tap winding employed by an alternative embodiment of the power transfer gimbal system.

FIG. 5 is a perspective view illustrating orientation of the two rotary power transformers 202, 204 used by an embodiment of a two-axis power transfer gimbal system 200. The rotational axis of the first rotary power transformer 202 is aligned along the Z axis of the power transfer gimbal system 200. The rotational axis of the second rotary power transformer 204 is aligned along the Y axis of the power transfer gimbal system 200 (FIG. 2).

The power connector 316 of the stator 306 of the first rotary power transformer 202 and the power connector 316 of the stator 306 of the second rotary power transformer 204 are coupled such that power can be communicated there through. Since the stator 306 of the first rotary power transformer 202 is affixed to the first rotational member 208 (not illustrated in FIG. 5), and since the stator 306 of the second rotary power transformer 204 is affixed to the second rotational member 210 (not illustrated in FIG. 5), the power connectors 316 remain in a substantially stationary position as the power transfer gimbal system 200 moves the communication device 120 and/or the antenna 102 (FIG. 2).

In the exemplary embodiment of FIG. 5, the power connectors 316 are coupled to an optional power conditioning device 502. The power conditioning device 502 may be operable to modify AC voltage or AC current. In some embodiments, the power conditioning device 502 is configured to convert AC current to a direct current (DC) and to convert the AC voltage into a DC voltage. A power connector 504 may be provided for coupling to a DC type device (not shown) which receives its power therefrom.

In some embodiments, the power connectors 316 may be directly coupled together or coupled together using an electrical connection. In some embodiments, a connector such as a spade, a screw, a clamp, or the like, may be used to couple the power connectors 316.

FIG. 2 illustrates a first electrical connection 212 between the base 118 and the first rotary power transformer 202, a second electrical connection 214 between the communication device 120 and the second rotary power transformer 204, and a third electrical connection 216 between the base 118 and the power source 206. (Alternatively, the second electrical connection 214 may be directly connected to the power source 206.) The electrical connections 212, 214, and/or 216 are electrical cables, cords, conductors, or the like.

During movement of the communication device 120 and/or the antenna 102, the first electrical connection 212 and the second electrical connection 214, having their ends secured to their respective rotor 304 (FIG. 3), remain in a substantially stationary position. That is, as the first rotational member 208 rotates, the rotation of the rotor 304 of the first rotary power transformer 202 allows the first electrical connection 212 to remain substantially stationary, thereby avoiding potentially damaging stresses that might otherwise cause failure of the first electrical connection 212. Similarly, as the second rotational member 210 rotates, the rotation of the rotor 304 of the second rotary power transformer 204 allows the second electrical connection 214 to remain substantially stationary, thereby avoiding potentially damaging stresses that might otherwise cause failure of the second electrical connection 214.

Figure 6:
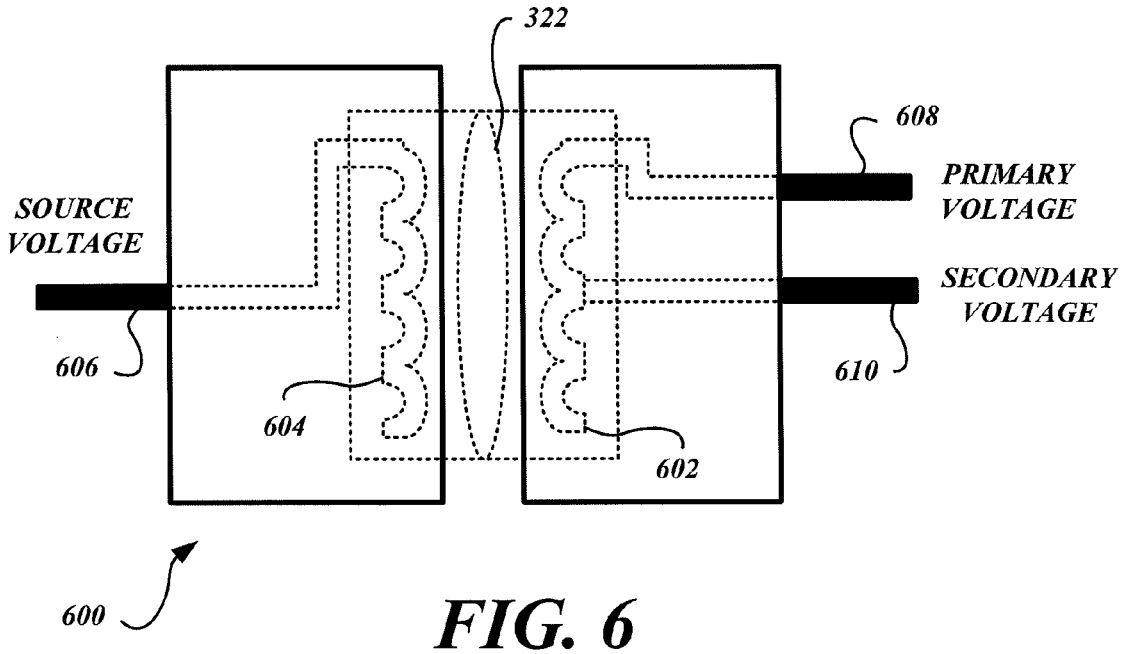
FIG. 6 is a perspective view illustrating orientation of two rotary power transformers of an embodiment of the power transfer gimbal system.

FIG. 6 illustrates a multi-tap winding power transfer gimbal system 600. In such embodiments, a multi-tap winding 602 is sourced by a source winding 604 that receives a source voltage and current from the power source 206 (FIG. 2) delivered at the power connector 606. The multi-tap winding 602 has a primary power connector 608 and a secondary power connector 610 coupled to the turns of its multi-tap winding 602. In a multi-tap winding embodiment, the turns ratio of the source winding 604 to the secondary power connector 608 of the multi-tap winding 602 will be different from the turns ratio of the source winding 604 to the primary power connector 610 of the multi-tap winding 602. Since the turns ratios are different, voltages at the primary power connector 608 and the secondary power connector 610 are different. Depending upon which axis the multi-tap winding power transfer gimbal system 600, the multi-tap winding 602 may be the winding of the rotor 304 or the winding of the stator 306 (FIG. 3).

For example, the primary voltage taken off of the multi-tap winding 602 at the primary power connector 608 may be used to power the communication device 120 and/or the antenna 102. The secondary voltage taken off of the multi-tap winding 602 at the secondary power connector 610 may be used to source a gimbal motor that utilizes a different voltage than the voltage of the primary power connector 608.

In alternative embodiments, the power transfer gimbal system 200 may be a one-axis gimbal system, a three-axis gimbal system, or a gimbal system with more than three axis. For each gimbal axis, a rotary power transformer 302 is used to provide a rotatable power connection.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A power source system comprising:

a gimbal comprising:

a first rotational member configured to rotate about a first axis;

a second rotational member configured to rotate about a second axis; and a moveable portion affixed to the first rotational member, wherein the moveable portion is oriented in a desired position by at least one of a first rotation of the first rotational member and a second rotation of the second rotational member;

a communication device physically coupled to the moveable portion of the gimbal, and that receives power for operation;

a first rotary power transformer comprising:

a first rotor;

a first rotor winding residing in the first rotor;

a first stator;

a first stator winding residing in the first stator; and a first power connector coupled to the first stator winding, wherein the first stator is affixed to the first rotational member; and a second rotary power transformer comprising:

a second rotor;

a second rotor winding residing in the second rotor;

a second stator;

a second stator winding residing in the second stator; and a second power connector coupled to the second stator winding and coupled to the first power connector, wherein the second stator is affixed to the second rotational member;

a first electrical connection with a first end coupled to the first rotor winding and a second end coupled to the communication device, wherein the first end of the first electrical connection remains in a first substantially stationary position as the gimbal orients the movable portion in the desired position; and a second electrical connection with a first end coupled to the second rotor winding and a second end coupled to a remote power source, wherein the first end of the second electrical connection remains in a second substantially stationary position as the gimbal orients the moveable portion in the desired position, wherein the first power connector remains substantially stationary with respect to the second power connector as the gimbal orients the moveable portion in the desired position, and wherein the remote power source supplies the power to the communication device via the second electrical connection, the first rotor winding, the first stator winding, the second stator winding, the second rotor winding, and the first electrical connection.

2. The power source system of claim 1, further comprising:

a radar antenna affixed to the moveable portion of the gimbal, wherein the gimbal points the radar antenna in a desired direction.

3. A method for transferring power from a remote power source to a communication device mounted to a gimbal system, the method comprising:

rotating a first rotational member of the gimbal system about a first axis, wherein a stator of a first rotary power transformer affixed to the first rotational member rotates about the first axis, and wherein an end of a first electrical connection coupled to a first power connector of a first rotor winding of the first rotary power transformer remains substantially stationary as the stator of the first rotary power transformer rotates about the first axis;

rotating a second rotational member of the gimbal system about a second axis, wherein a stator of a second rotary power transformer affixed to the second rotational member rotates about the second axis, and wherein an end of a second electrical connection coupled to a power connector of a rotor winding of the second rotary power transformer remains substantially stationary as the stator of the second rotary power transformer rotates about the second axis; and transferring power from the remote power source to the communication device via the second electrical connection, the first rotor winding, a first stator winding in the stator of the first rotary power transformer, a second rotor winding in the stator of the second rotary power transformer, and the first electrical connection.

4. The method of claim 3, wherein a first power connector coupled to a stator winding of the first rotary power transformer and with a second end coupled to a stator winding of the second rotary power transformer remains substantially stationary as the stators of the first and the second rotary power transformers rotate.

5. A rotary power transformer system for providing power to a communication device on a gimbal, the gimbal having a first rotational member configured to rotate about a first axis to orient the communication device in a desired position, the gimbal having a second rotational member configured to rotate about a second axis to orient the communication device in the desired position, the rotary power transformer system comprising:

a first rotary power transformer comprising:

a first stator;

a first rotor rotationally coupled to the first stator;

a first stator connector configured to attach the first stator to a first rotational member of the gimbal;

a first stator winding residing in the first stator;

a first rotor winding residing in the first rotor; and a first rotor power connector coupled to the first rotor winding and configured to couple to an end of a first electrical connection that is connected to a remote power source; and a second rotary transformer comprising:

a second stator;

a second rotor rotationally coupled to the second stator;

a second stator connector configured to attach the second stator to a second rotationally member of the gimbal;

a second stator winding residing in the second stator;

a second rotor winding residing in the second rotor; and a second rotor power connector coupled to the second rotor winding and configured to couple to an end of a second electrical connection that is connected to the communication device, wherein the first rotor power connector and the end of the first electrical connection to the remote power source remain substantially stationary as the gimbal orients the communication device to the device position, and wherein the remote power source supplies the power to the communication device via the second electrical connection, the first rotor winding, the first stator winding, the second stator winding, the second rotor winding, and the first electrical connection.

6. The rotary power transformer system of claim 5, wherein the communication device is a communication device coupled to a radar antenna, wherein the gimbal points the radar antenna in a desired direction.

* * * * *